United States Patent [19]

Farmer

[11] Patent Number: 4,561,202

[45] Date of Patent: Dec. 31, 1985

[54] PICTURE SCENE APPARATUS

[76] Inventor: William R. Farmer, 215 Campbell St., New Westminster B.C., Canada, V3M-5K8

[21] Appl. No.: 512,586

[22] Filed: Jul. 11, 1983

[51] Int. Cl.[4] ..... G09F 11/04

[52] U.S. Cl. ..... 40/495; 40/160; 446/325

[58] Field of Search ..... 40/160, 495; 446/129, 446/134, 132 R, 325; 272/31 R

[56] References Cited

U.S. PATENT DOCUMENTS

| | | | |
|---|---|---|---|
| 2,284,903 | 6/1942 | Illmer | 40/495 |
| 2,814,895 | 12/1957 | Flam | 40/160 |
| 3,201,125 | 8/1965 | Vensel | 446/129 |
| 3,803,735 | 4/1974 | Stubbmann | 446/129 |
| 3,822,494 | 7/1974 | Zivica | 40/160 |
| 3,949,506 | 4/1976 | Benkowski | 40/160 |

FOREIGN PATENT DOCUMENTS

| | | | |
|---|---|---|---|
| 1185949 | 8/1959 | France | 446/134 |

*Primary Examiner*—Gene Mancene
*Assistant Examiner*—Wenceslao J. Contreras
*Attorney, Agent, or Firm*—Fetherstonhaugh & Co.

[57] ABSTRACT

An ornament has a frame. There is a central fixed disc attached to the frame and a picture of the central fixed disc. An annulus surrounds the central fixed disc and is rotatably mounted in the frame. A magnet is positioned in the annulus. Weighted figures are mounted on the rotatable annulus. The figures bear a relationship to the picture on the central fixed disc. A magnet can rotate the annulus by magnetic effect on the magnet in the annulus so that the weighted figures rise and fall as the annulus rotates to change the displayed scene.

6 Claims, 3 Drawing Figures

PICTURE SCENE APPARATUS

FIELD OF THE INVENTION

This invention relates to an ornament, in particular to an ornament in which a display picture can be changed by rotation of at least part of the ornament.

DESCRIPTION OF THE PRIOR ART

An object of the invention is to provide a picturesque ornament in which certain figures, preferably animals and the like, can move to present a mobile display that is both attractive and interesting.

SUMMARY OF THE INVENTION

Accordingly the present invention is an ornament comprising a frame; a central disc attached to the frame; a picture on the central fixed disc; and annulus around the central fixed disc and rotatably located in the frame; a first magnet located in the annulus; weighted figures mounted on the rotatable annulus, the figures bearing a relationship to the picture on the central fixed disc; magnetic means to rotate the annulus by magnetic effect on the first magnet whereby the weighted figures rise and fall as the annulus rotates to change the displayed scene.

DRAWINGS

Aspects of the invention are illustrated, merely by way of example, in the drawings in which.

DESCRIPTION OF THE PREFERRED EMBODIMENTS

Figure 1:
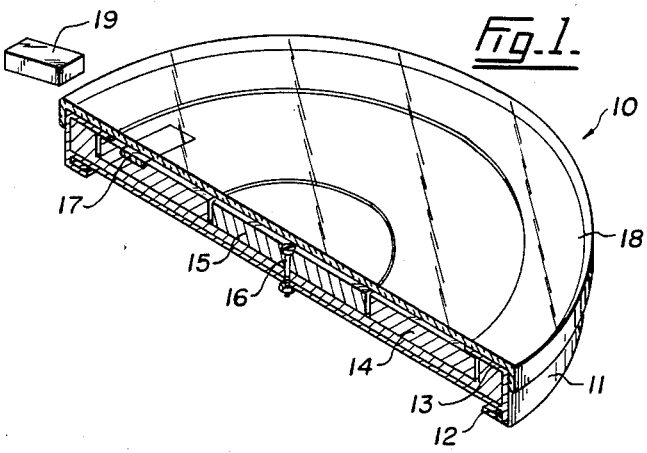
FIG. 1 is a section through an embodiment of the present invention.

The drawings show an ornament 10 comprising a frame 11 formed with a peripheral upstanding portion. A lip 13 is mounted on the frame 11 and extends inwardly of the frame. There is a rotatable annular disc 14 located in the frame 11 by the lip 13. There is a central fixed disc 15 attached to the frame 11 by bolt 16. In the illustrated embodiment, to ensure that the central fixed disc, should it work loose, hangs in the correct position there is provided a weight 34 at its periphery acting to ensure that the central disc 15 is always in the correct position. The annular disc 14 is provided with a magnet 17 and the ornament is covered by a glass cover 18. Hand-held magnet 19 can then be used to exert a magnetic effect on the magnet 17 mounted in the disc 14.

The ornament is provided with a hanger 12 to enable its hanging on a hook or the like on the wall.

Figure 2:
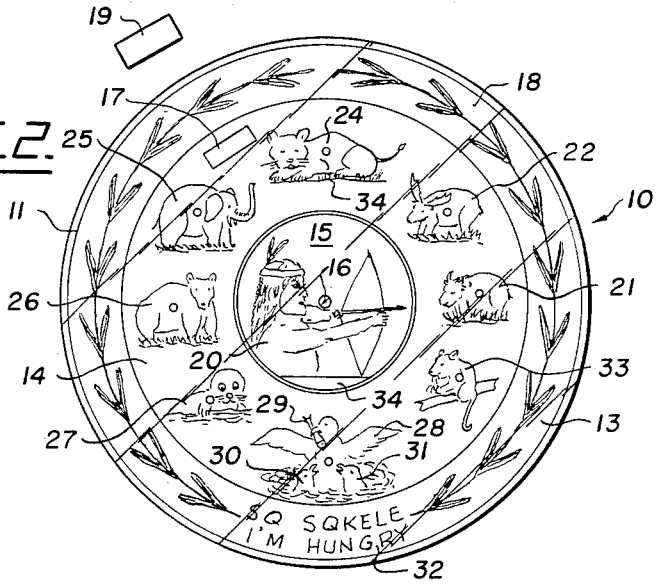
FIG. 2 is a plan view of one embodiment of the present invention.

FIG. 2 illustrates the mounting of various animals on the disc 14. These animals are weighted figures movably mounted by pivot pins on the disc 14. In FIG. 2, for example an Indian hunter 20 is shown on the central fixed disc and a buffalo 21, moose 22 and 23, lion 24, elephant 25, bear 26, seal 27, eagle 28 feeding a fish 29 to her chicks 30 and 31 and a monkey 33. As shown at 32 wording can be incorporated in the frame, for example fancifully duplicating the language of the eagle-chicks or conveying a message, as in FIG. 3.

As shown in FIG. 2 the central fixed disc has a picture that bears a relationship to the figures on the annulus 14. That is the Indian hunter 20 forms a part of a whole scene with the animals on the disc 14.

Figure 3:
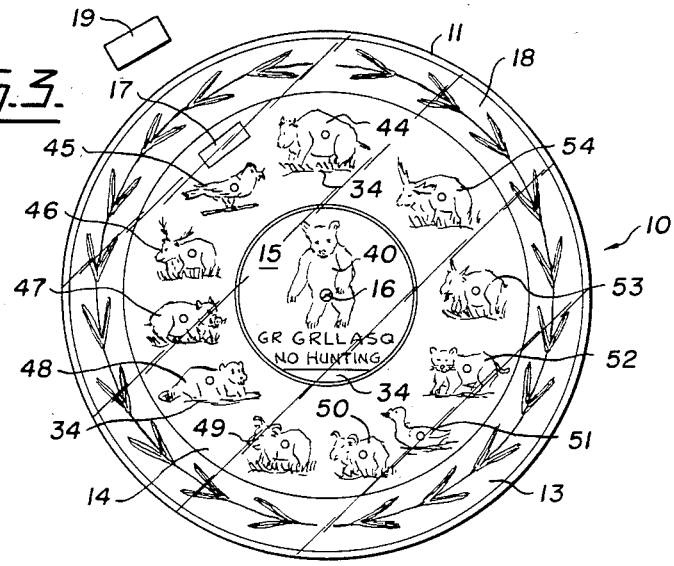
FIG. 3 is a plan view of a further embodiment of the present invention.

In FIG. 3 other animals are shown for example a grizzly bear 40 on the central disc 15, and buffalo 44, eagle 45, deer 46, boar 47, beaver 48, sheep 49, sheep 50, goose 51, cougar 52, goat 53 and moose 54 on the disc 14.

The arrangement is that when the annulus is rotated by the effect of the hand-held magnet 19 on the magnet 17 on the disc 14 the scene constantly changes by the shifting movement of the figures mounted on the disc 14. If necessary a video tap can be used to provide a commentary, for example, about hunting, as shown in FIG. 3.

I claim:

1. An ornament comprising:

a frame;

a central fixed disc attached to the frame;

a picture on the central fixed disc;

an annulus surround the central fixed disc and rotatably located in the frame;

a first magnet located in the annulus;

weighted figures mounted on the rotatable annulus, the figures bearing a relationship to the picture on the central fixed disc;

magnetic means to rotate the annulus by magnetic effect on the first magnet whereby the weighted figures rise and fall as the annulus rotates to change the displayed scene.

2. An ornament as claimed in claim 1 provided with a glass cover over the central disc and the annulus.

3. An ornament as claimed in claim 1 in which the magnetic means to rotate the annulus is a hand-held magnet.

4. An ornament as claimed in claim 1 including means to hang the ornament on a hook.

5. An ornament as claimed in claim 1 in which the central fixed disc is self-righting.

6. An ornament as claimed in claim 5 in which the central fixed disc is made self-righting by the provision of a weight as part of the circumference.

* * * * *